200-52 SP
10/22/85 XR 4,548,250

United States Patent [19]

Meharg et al.

[11] Patent Number: 4,548,250

[45] Date of Patent: Oct. 22, 1985

[54] APPARATUS FOR OPERATING A LINE DRIVEN DEVICE

[75] Inventors: Richard D. Meharg, Winfield; Buckley A. Singletary, Plainfield, both of Ill.

[73] Assignee: Sears, Roebuck & Co., Chicago, Ill.

[21] Appl. No.: 530,957

[22] Filed: Sep. 12, 1983

[51] Int. Cl.[4] ..... A47H 1/00

[52] U.S. Cl. ..... 160/331; 254/269; 200/52 R

[58] Field of Search ..... 160/331, 126, 330; 200/61.13, 61.15, 61.39, 61.62, 61.84; 254/269; 318/267

[56] References Cited

U.S. PATENT DOCUMENTS

| | | | |
|---|---|---|---|
| 1,831,128 | 11/1931 | McKenny et al. | 160/331 |
| 2,111,009 | 3/1938 | Smith | 160/331 X |
| 2,766,417 | 10/1956 | Merritt | 200/61.13 X |
| 3,700,186 | 10/1972 | Burnham | 200/61.13 X |
| 4,492,262 | 1/1985 | Comeau | 160/331 X |

*Primary Examiner*—Ramon S. Britts
*Assistant Examiner*—David M. Purol
*Attorney, Agent, or Firm*—Wood, Dalton, Phillips, Mason & Rowe

[57] ABSTRACT

An apparatus for operating a line driven device such as a traverse rod. The apparatus includes a frame member adapted to be mounted on or near the device, a reaction arm mounted on the frame member for pivotal movement, a motor mounted on the reaction arm and having an output shaft with a drive member, the reaction arm being adapted for pivotal movement about the output shaft, and a tensioning member disposed in spaced relation to the drive member. With this arrangement, the tensioning member can engage a line to maintain the line in tension in response to pivotal movement of the reaction arm.

21 Claims, 6 Drawing Figures

APPARATUS FOR OPERATING A LINE DRIVEN DEVICE

BACKGROUND OF THE INVENTION

The present invention generally relates to an apparatus for operating a line driven device and, more particularly, to a motorized drapery actuator with means for maintaining tension in a continuous line by using a movable reaction arm.

Motorized drapery actuators have been used for many years with widely varying approaches. One proposed technique is to use an endless perforated band with pulleys driven by a gear reduction mechanism where the change in draw is accomplished with an ordinary electric motor. Another proposed technique is to use a linear actuator to drive cords or lines in conjunction with pulleys where a single pole double throw switch is used to change the draw direction. Still another proposed technique is to use a gear reduced induction motor in conjunction with pressure rollers to accomplish the driving function where the cord tension is preconditioned at the end of the drive cycle by reversing the motor momentarily to relieve the tension. With this last approach, the pressure rollers are adapted to work with the cords which are conventionally strung in traverse rods.

While there has been many different motorized drapery actuators proposed over the years, and such approaches have experienced varying degrees of success, it has remained to provide a motorized drapery actuator entirely satisfactory in nearly every aspect.

It is therefore an object of the present invention to provide a motorized drapery actuator which takes full advantage of the many features inherent in such devices, and adds important new features, while overcoming the remaining obstacles to perfecting the design, construction and operation thereof.

These and other objects, features and advantages of the present invention will become apparent from the following description when considered in connection with the accompanying drawings.

SUMMARY OF THE INVENTION

In general, the objects and advantages of the present invention are met by providing an apparatus for operating a line driven device such as a traverse rod. The apparatus includes a frame member adapted to be mounted on or near the device, a reaction arm mounted on the frame member for pivotal movement, a motor mounted on the reaction arm and having an output shaft with drive means, the reaction arm being adapted for pivotal movement about the output shaft, and tensioning means disposed in spaced relation to the drive means. With this arrangement, a line driven by the drive means can be maintained in tension by engagement of the line with the tensioning means in response to pivotal movement of the reaction arm.

In a preferred embodiment, the drive means pulls one end of the line while the tensioning means engages the other end of the line. The tensioning means is then displaced to provide an increased tension in response to an increased load. This is accomplished with structure in which the frame member includes first and second spaced apart frame surfaces and the reaction arm similary includes first and second spaced apart arm surfaces such that the arm surfaces are disposed adjacent and parallel to the frame surfaces. The arm surfaces are then joined for simultaneous pivotal movement. With this arrangment, the output shaft and drive means extend between the arm surfaces and the tensioning means includes a movable roller extending between the arm surfaces.

In still other particulars, the tensioning means also preferably includes a stationary roller extending between the frame surfaces. Additionally, the drive means is suitably a capstan carrying a plurality of turns of the line and arranged to pull one end of the line while the movable roller engages the other end of the line. If an increased load is experienced, the movable roller is pivotally displaced to provide an increased tension sufficient to ensure a driving friction between the line and the capstan.

Among the other features of the present invention is the use of a reversible electric motor joined through the output shaft through a gear reduction mechanism. Control means for the motor is then provided to permit selective actuation of the apparatus and also suitably includes reversing switch means permitting the line to be driven in either direction and limit switch means for controlling the extent of travel of the line in each direction. In a prefered embodiment of the invention, the limit switch means is operable in response to movement of the reaction arm.

With these features of construction, the motorized drapery actuator of the present invention accomplishes the object defined hereinabove.

DETAILED DESCRIPTION OF THE PREFERRED EMBODIMENT

Figure 1:
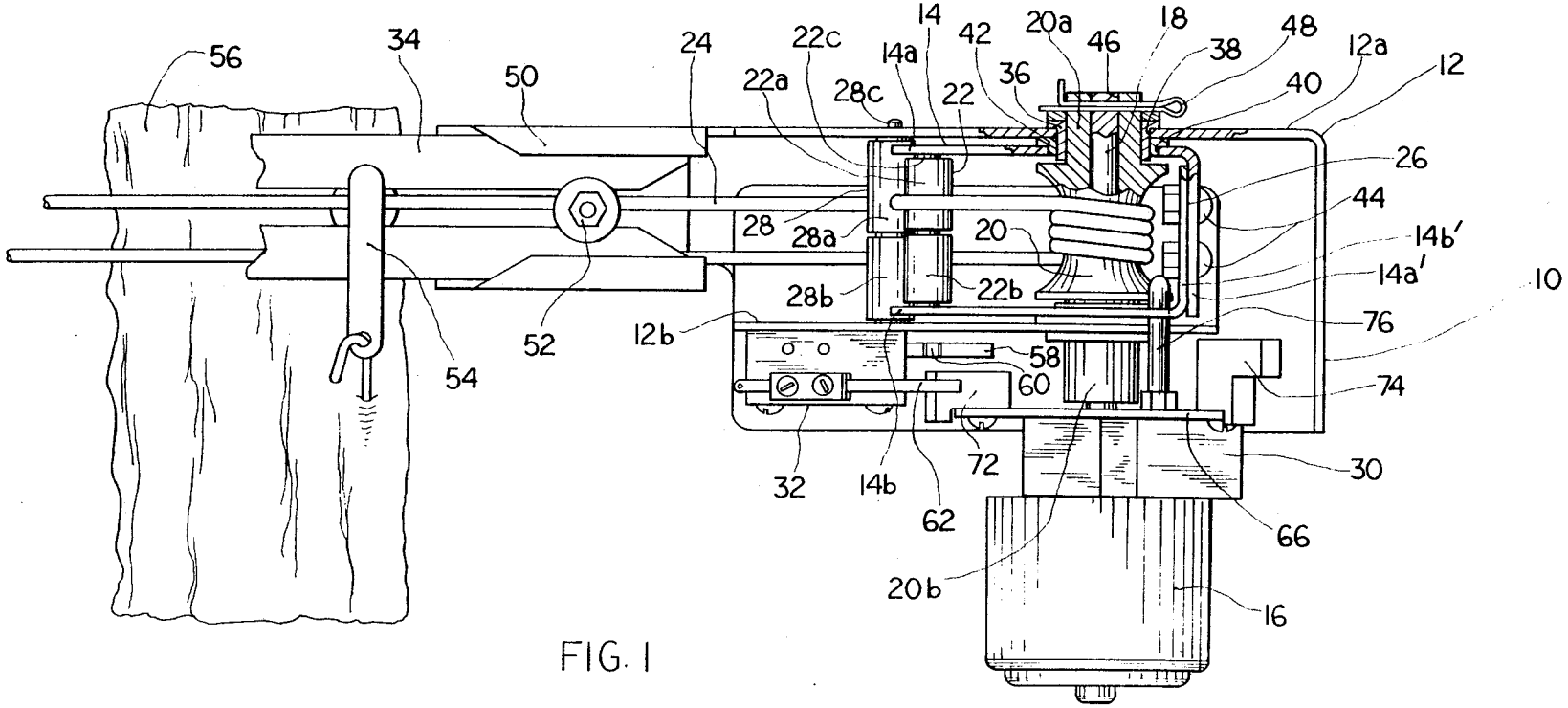
FIG. 1 is a rear elevational view of an apparatus for operating a line driven device in accordance with the present invention.

In the illustration given, and with reference first to FIG. 1, the reference numeral 10 designates generally an apparatus for operating a line driven device in accordance with the present invention. The apparatus 10 includes a frame member 12 adapted to be mounted near the device, a reaction arm 14 mounted on the frame member 12 for pivotal movement, a motor 16 mounted on the reaction arm 14 (as will be described in detail hereinafter) and having an output shaft 18 with drive means such as a capstan 20, the reaction arm 14 being adapted for pivotal movement about the output shaft 18, and tensioning means such as a movable roller 22 disposed in spaced relation to the capstan 20. With this arrangement, a line 24 driven by the capstan 20 can be maintained in tension by engagement of the line with the movable roller 22 in response to pivotal movement of the reaction arm 14 about the output shaft 18 of the motor 16.

Figure 2:
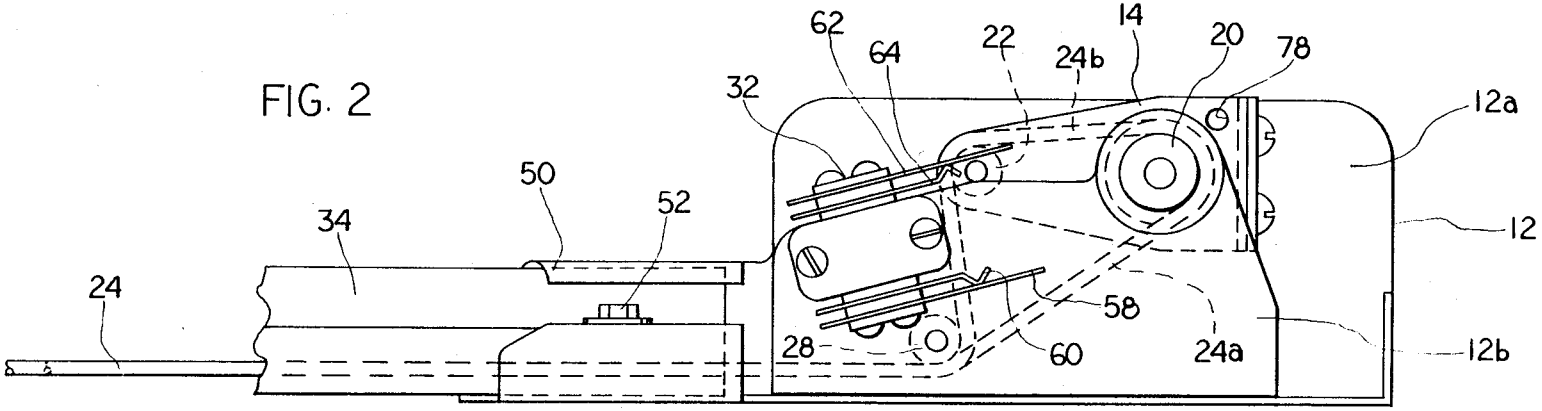
FIG. 2 is a bottom plan view, with the motor and gear reduction mechanism omitted, of the apparatus of the present invention.

Referring to FIG. 2, the capstan 20 pulls one end 24a of the line 24 while the movable roller 22 engages the other end 24b of the line 24. The movable roller 22 is displaced to provide an increased tension in the end 24b of the line 24 in response to an increased load in the end 24a of the line 24. As a result of displacement of the movable roller 22, the line 24 is displaced to thereby ensure a driving friction between the line 24 and the capstan 20.

Referring to FIGS. 1 and 2, the frame member 12 includes first and second spaced apart frame surfaces 12a and 12b. The reaction arm 14 also includes first and second spaced apart arm surfaces 14a and 14b, and the arm surfaces 14a and 14b are disposed adjacent and parallel to the frame surfaces 12a and 12b. As will be appreciated, the arm surfaces 14a and 14b are joined together for simultaneous pivotal movement as at 26.

Referring specifically to FIG. 1, the output shaft 18 and the capstan 20 extend between the arm surfaces 14a and 14b, as will be described in detail hereinafter. It will also be seen that the tensioning means includes not only a movable roller 22 extending between the arm surfaces 14a and 14b but also includes a stationary roller 28 extending between the frame surfaces 12a and 12b. Also as shown, the capstan 20 carries a plurality of turns of the line 24 with the ends 24a and 24b following a path about the movable roller 22 and the stationary roller 28, as shown in FIGS. 1 and 2.

While the details have been omitted for clarity, the motor 16 is suitably a reversible electric motor joined to the output shaft 18 through a gear reduction mechanism 30. It will also be appreciated that control means will be provided for the motor 16 adapted to permit selective actuation of the apparatus 10 and control means in the form of a reversing switch will also be provided to permit the line 24 to be driven in either direction. Finally, a limit switch 32 is utilized to control the extent of travel of the line 24 in each direction, and the limit switch 32 is operable in response to movement of the reaction arm 14, as will be described in detail hereinafter.

In a preferred practical application, the apparatus 10 is a motorized drapery actuator. The reaction arm 14 is arranged such that the drive roller or capstan 20 is mounted in spaced relation to the movable or tensioning roller 22 and, similarly, the stationary roller 28 is mounted on the frame in spaced relation to both the drive roller or capstan 20 and the movable or tensioning roller 22. Additionally, the line 24 is a continuous line having a plurality of turns on the drive roller or capstan 20 with the line 24 extending from the capstan 20 on opposite sides thereof.

With the preferred embodiment of the invention, the portion 24a of the line 24 passes directly over the stationary roller 28. It will also be seen that the portion 24b of the line 24 first passes over the movable or tensioning roller 22 and then passes over the stationary roller 28. Moreover, as will be appreciated, the continuous line 24 is operatively joined to a master carrier 34 of a traverse rod at a point beyond the stationary roller 28.

Referring once again to FIG. 1, the exact construction of the apparatus 10 can be better understood. The capstan 20 includes extended end portions 20a and 20b that pass through bearings (such as 36) disposed in openings (such as 38) in the frame surfaces 12a and 12b and, in addition, it will be appreciated that the extended end portions 20a and 20b extend through openings (such as 40) in the arm surfaces 14a and 14b of the reaction arm 14. Also as shown, suitable bearings (such as 42) are disposed in the openings in the reaction arm 14.

As can be seen, the bearings (such as 42) maintain the frame surfaces 12a amd 12b slightly spaced from the arm surfaces 14a and 14b while engaging the bearings (such as 36) to facilitate relative pivotal movement between the frame 12 and the reaction arm 14. Moreover, since the arm surfaces 14a and 14b include oppositely directed rear connecting portions 14a' and 14b' joined by means of fasteners 44, the arm surfaces 14a and 14b will simultaneously pivot about the output shaft 18 of the motor 16.

In this connection, the output shaft 18 of the motor 16 extends completely through an axial bore 46 in the capstan 20. The entire assembly comprised of the motor 16, the gear reduction mechanism 30 and the output shaft 18 is then maintained in position in intergral relation with the capstan 20 by means of a cotter pin 48. With this arrangement, the line 24 is driven by the capstan 20 by means of the motor 16 and the torque of the motor 16 acts through the vertical stud 76 to cause the reaction arm 14 to pivot about the output shaft 18.

Still referring to FIG. 1, the movable roller 22 and the stationary roller 28 may advantageously be "split rollers". This means that they each include two roller portions 22a, 22b and 28a, 28b, respectively, mounted on a single roller shaft 22c and 28c, respectively, where the roller shafts 22c and 28c are fastened in the arm surfaces 14a and 14b and the frame surfaces 12a and 12b, respectively. As will be appreciated, the roller portions 22a, 22b and 28a, 28b are free to rotate in opposite directions when contacted by the oppositely traveling end portions 24a and 24b of the continuous line 24.

With the present invention, the apparatus 10 is adapted to be mounted on or near the traverse rod 34. It will be seen from FIGS. 1 and 2 that the embodiment illustrated includes an extension 50 on the frame 12 adapted to slide onto the end of the traverse rod 34 and be secured thereto. Bumper 52 acts as a stop for the carriers 54 for the drapery 56 which are adapted to travel along the traverse rod. When the drapery 56 has been fully opened, the carriers (such as 54) will bunch together in close proximity near the bumper 52.

As this occurs, the load on the end 24a of the continuous line 24 increases rapidly. The increased load is met by an increased torque which causes the reaction arm 14 to pivot about the output shaft 18 so as to pivotally displace the movable tensioning roller 22 to provide an increased tension on the other end 24b of the continuous line 24 to ensure a driving friction between the line 24 and the capstan 20. However, as the load increases rapidly, the movable tensioning roller 22 is further pivotally displaced until the limit switch 32 shuts off the motor 16.

Figure 3:
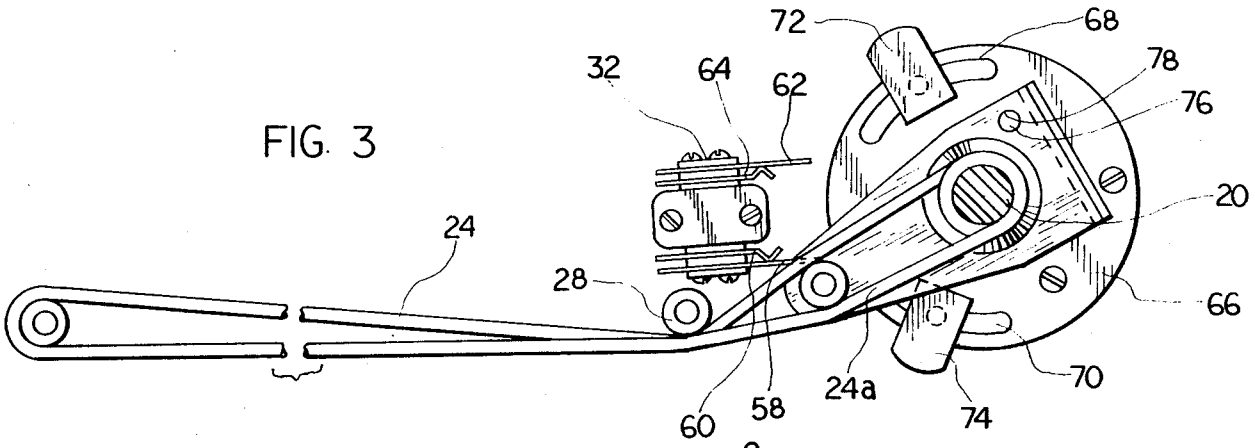
FIG. 3 is a top plan view of the operating components with the motor, frame and gear reduction mechanism omitted to facilitate understanding of the limit switch means, taken on the line 3—3 in FIG. 1.

By referring to FIGS. 1 and 3, the limit switch 32 can be better understood. It will be seen that it preferably includes two pairs of spring metal contacts 58, 60 and 62, 64, respectively, mounted on the underside of the frame surfaces 12b in spaced relation to the vertical axis defined by the output shaft 18, and the limit switch 32 also includes a circular plate 66 having angularly spaced slots 68 and 70 in which non-conductive lugs 72 and 74 may be adjustably mounted. As can be seen from FIG. 1, the contacts 62, 64 and lug 72 are vertically spaced from the contacts 58, 60 and the lug 74.

More particularly, the lug 72 is dimensioned so as to pass under the contacts 58, 60 and only engage the contact 62 while the lug 74 is vertically stepped so as to pass over the contacts 62, 64 and only engage the contact 58. With this arrangement, the lugs 72 and 74 can be adjustably positioned within the slots 68 and 70, respectively, to open the contacts 62, 64 and 58, 60, respectively, when the drapes are fully opened and fully closed, respectively.

As can be seen from FIG. 1, the mounting plate 66 is caused to move pivotally about the output shaft 18 with the reaction arm 14 by means of the vertical stud 76. The stud 76 is secured to the mounting plate 66 and extends through an opening 78 in the arm surface **14*b* which transmits the pivotal movement of the reaction arm 14. With this arrangement, the limit switch 32 is operable in response to movement of the reaction arm 14 to control the extent of travel of the line 24** in each direction.

Figure 4:
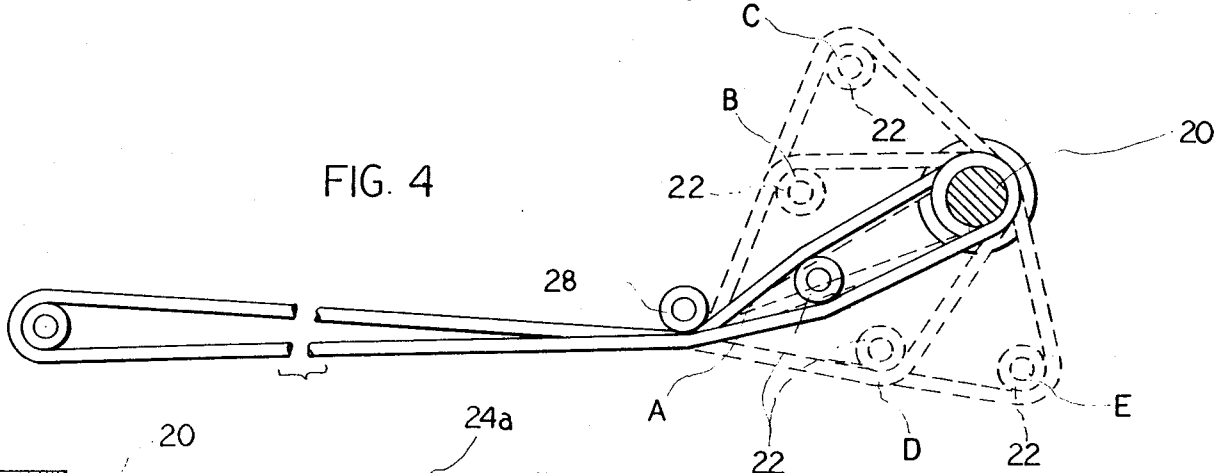
FIG. 4 is a schematic illustration of the operation of the apparatus of the present invention.

Referring to FIG. 4, the approximate line positions are illustrated for different operational phases. Position A depicts an unloaded at rest condition with the movable tensioning roller 22 in a neutral state. Position B shows the end portion **24*b* of the line 24 and the movable tensioning roller 22 when driven in a forward direction under normal operating loads. Position C depicts a condition where a substantially higher load is encountered such as when the drapery 56 is fully opened to the end of its travel at which point the lug 74 will engage the contact 58 and separate it from engagement with the contact 60 to stop the operation of the motor 16 after which the motor can only be driven in the reverse direction, an outside reversing switch being provided to change motor direction upon actuation thereof. Position D shows the end portion 24*a* of the line 24 and the movable tensioning roller 22 when driven in a reverse direction under normal operating loads. Position E depicts a reverse direction, end-of-travel limit similar to the condition described for Position C. In Position E, the difference is that a substantially higher load is encountered such as when the drapery 56 is fully closed to the other end of its travel at which point the lug 72 engages the contact 62 and separates it from engagement with the contact 64**.

For all positions, the movable tensioning roller 22 is applying a force to the line 24 which is being played out from the capstan 20. This tensioning force is essential to ensure that proper driving friction is applied between the line 24 and the capstan 20 and this force is self-compensating in that the more pulling demand that is made on the motor 16, the more reaction torque is applied through pivotal movement of the reaction arm 14 and the movable tensioning roller 22 to the line 24. If this did not occur, the line 24 would slacken and reduce the pulling force in an undesirable fashion.

Figure 6:
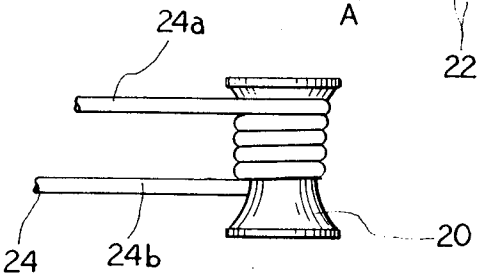
FIG. 6 is a side elevational view of the drive roller with the line being driven in the reverse direction.
Figure 5:
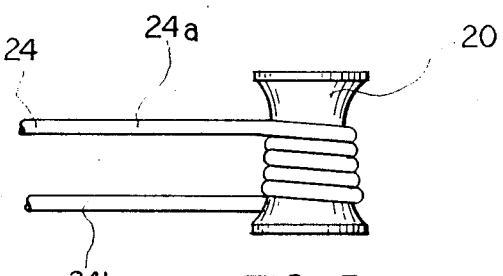
FIG. 5 is a side elevational view of the drive roller with the line being driven forward under load.

Referring to FIG. 5, the capstan 20 is shown with the line 24 dressed as it would be when driven forward under load. It will be seen that three or four complete wraps of the line 24 about the capstan 20 are typical. Referring to FIG. 6, the capstan 20 is shown with the line 24 dressed as it would be when driven in the reverse direction.

Generally, the line 24 will bias toward the side of the capstan 20 from which it is being taken up due to a natural screw-type action caused by line wrap. The capstan 20 is shaped so as to stop or limit this screw-type action. It is also of increasing diameter which causes the line 24 to climb a sloped wall until the angles and forces involved become such that a controlled transverse slip is accomplished but with no appreciable slippage in the pulling direction. The capstan 20 is designed to exert a basically constant pulling action on the line 24. Moreover, since controlled transverse slip is required and slippage in the direction of pull must be eliminated, the conditions required may be enhanced by including axial grooves (not shown) in the face of the capstan 20 capable of allowing transverse slip but preventing slip in the pulling direction.

While not shown, it is evident that a physical stop, if placed in the path of drapery hardware travel, would cause conditions similar to those described for fully opened and fully closed draperies hereinabove. Furthermore, any means used which would cause motor demand to increase sufficiently to trip the limit switch 32 could be used for control purposes. Additionally, other drive assemblies, limit switches, and line routings are possible. As will be appreciated, this is true even where the drive assembly may be externally mounted remote from the traverse rod as opposed to the integral design described herein.

While no control circuit has been illustrated, it will be appreciated by those skilled in the art that many different types of circuits are suitable for use with the apparatus of the present invention. Among such circuits are a basic control circuit which may include a center off reversing switch wired so that it works in conjunction with the operation of a limit switch to effect reversal of the motor, a circuit utilizing a single, momentary-contact switch and a latching relay making remote mounting of a one-button control possible and lending itself to adaptation for controls other than manual switching, i.e., time delay and light or heat sensing circuitry, and a circuit utilizing a reversing-type limit switch, a silicon control rectifier, a current limiting resistor, and a momentary-contact switch which provides a lower cost by utilizing solid state components. As will be appreciated, the invention is not to be construed as limited to the circuits described which are presented only to show the inherent versitility of control available.

Various changes coming within the spirit of the present invention may suggest themselves to those skilled in the art. Hence, it will be understood that the invention is not to be limited to the specific embodiments shown and described or the uses mentioned. On the contrary, the specific embodiments and uses are intended to be merely exemplary with the present invention being limited only by the true spirit and scope of the appended claims.

We claim:

1. An apparatus for operating a line driven device, comprising:

a frame member adapted to be mounted near said device;

a reaction arm pivotally mounted on said frame member;

a motor mounted on said reaction arm and having an output shaft with drive means; a line driven by said drive means; and tensioning means on said reaction arm in spaced relation to said drive means, said tensioning means being in engagement with said line and adapted for pivotal movement with said reaction arm about said output shaft of said motor in a direction increasing tension on said line, said tensioning means and reaction arm being pivotally displaced by an increase in torque of said motor in response to an increased load to ensure a driving friction between said line and said drive means;

whereby said line driven by said drive means is maintained in tension by engagement and displacement of said line with said tensioning means in response to pivotal movement of said reaction arm about said output shaft of said motor.

2. The apparatus as defined by claim 1 wherein said drive means pulls one end of said line while said tensioning means engages and displaces the other end of said line.

3. The apparatus as defined by claim 1 wherein said frame member includes first and second spaced apart frame surfaces.

4. The apparatus as defined by claim 3 wherein said reaction arm includes first and second spaced apart arm surfaces.

5. The apparatus as defined by claim 4 wherein said arm surfaces are disposed adjacent and parallel to said frame surfaces.

6. The apparatus as defined by claim 5 wherein said arm surfaces are joined for simultaneous pivotal movement.

7. The apparatus as defined by claim 6 wherein said output shaft and said drive means extend between said arm surfaces.

8. The apparatus as defined by claim 7 wherein said tensioning means includes a movable roller extending between said arm surfaces.

9. The apparatus as defined by claim 8 wherein said tensioning means also includes a stationary roller extending between said frame surfaces.

10. The apparatus as defined by claim 9 wherein said drive means is a capstan carrying a plurality of turns of said line.

11. The apparatus as defined by claim 10 wherein said capstan pulls one end of said line while said movable roller engages and displaces the other end of said line.

12. The apparatus as defined by claim 11 wherein said motor is a reversible electric motor joined to said output shaft through a gear reduction mechanism.

13. The apparatus as defined by claim 12 including control means for said motor adapted to permit selective actuation of said apparatus.

14. The apparatus as defined by claim 13 wherein said control means includes reversing switch means permitting said line to be driven in either direction.

15. The apparatus as defined by claim 14 wherein said control means includes limit switch means for controlling the extent of travel of said line in each direction.

16. The apparatus as defined by claim 15 wherein said limit switch means is operable in response to movement of said reaction arm.

17. A motorized drapery actuator, comprising:

a frame member;

a reaction arm mounted on said frame member, said reaction arm having a drive roller and a tensioning roller mounted in spaced relation, said reaction arm and tensioning roller being pivotally movable about said drive roller;

a motor mounted on said reaction arm and having an output shaft operatively joined to said drive roller;

a stationary roller mounted on said frame in spaced relation to said drive roller and said tensioning roller; and a continuous line having a plurality of turns on said drive roller, said line extending from said drive roller on opposite sides thereof such that the portion extending from one side of said drive roller first passes over said tensioning roller and then passes over said stationary roller and the portion extending from the other side of said drive roller passes directly over said stationary roller, said continuous line being operatively joined to a traverse rod at a point beyond said stationary roller;

said tensioning roller being pivotally movable with said reaction arm in a direction increasing tension on said continuous line, said tensioning roller and reaction arm being pivotally displaced by an increase in torque of said motor in response to an increased load to ensure a driving friction between said continuous line and said drive roller;

whereby said continuous line can be maintained in tension by engagement and displacement of said line with said tensioning roller in response to pivotal movement of said reaction arm about said drive roller.

18. The motorized drapery actuator as defined by claim 17 wherein said drive roller is a capstan adapted to pull the line portion extending from one side of said drive roller while said tensioning roller engages and displaces the line portion extending from the other side of each drive roller.

19. The motorized drapery actuator as defined by claim 18 including control means for said motor adapted to permit selective operation of said actuator, said motor being a reversible electric motor joined to said output shaft through a gear reduction mechanism, said control means also including limit switch means.

20. The motorized drapery actuator as defined by claim 19 wherein said control means includes reversing switch means permitting said line to be driven in either direction, said limit switch means being adapted to control the extent of travel of said line in each direction.

21. The motorized drapery actuator as defined by claim 17 wherein said frame member is adapted to be mounted on or near said traverse rod.

* * * * *